United States Patent [19]

Kies

[11] Patent Number: 4,526,437

[45] Date of Patent: Jul. 2, 1985

[54] ELECTRICAL BRACKET

[75] Inventor: Anton M. Kies, Oisterwijk, Netherlands

[73] Assignee: Erico Products, Inc., Cleveland, Ohio

[21] Appl. No.: 476,227

[22] Filed: Mar. 17, 1983

[51] Int. Cl.[3] ..... H01R 4/36

[52] U.S. Cl. ..... 339/272 R

[58] Field of Search ..... 339/272, 263, 244 B, 339/249 B

[56] References Cited

U.S. PATENT DOCUMENTS

| | | | |
|---|---|---|---|
| 1,335,943 | 4/1920 | Emens | 339/272 R |
| 1,798,812 | 3/1931 | Rosenbeck | 339/272 R |
| 2,006,794 | 7/1935 | Davidson | 339/272 UC |
| 2,106,595 | 1/1938 | Draving | 339/263 R |
| 2,164,006 | 6/1939 | Dibner et al. | 339/244 B |

FOREIGN PATENT DOCUMENTS

| | | | |
|---|---|---|---|
| 652945 | 11/1937 | Fed. Rep. of Germany | 339/272 R |
| 2509427 | 9/1976 | Fed. Rep. of Germany | 339/272 R |
| 66260 | 3/1956 | France | 339/272 R |

*Primary Examiner*—Gil Weidenfeld
*Assistant Examiner*—David L. Pirlot
*Attorney, Agent, or Firm*—Maky, Renner, Otto & Boisselle

[57] ABSTRACT

A ground rod electrical connection bracket (10) includes a bent sheet metal receiving member (12), the end (13) of which are bent into opposed semi-cylindrical shapes and provided with screw threads (18). The ends (13) are provided with a rim (19) and by pinching the ends, a ring (14) may be positioned behind the rim around the semi-cylindrical ends. A corrosion resistant bolt (17) engages the screw threads to clamp a connecting wire (16) against the ground rod (15). The connecting wire is seated between the ground rod and an acute corner (22) of the receiving member.

6 Claims, 2 Drawing Figures

ELECTRICAL BRACKET

The invention relates to a bracket for forming an electrical connection and for holding at least one object comprising a web having an internally screwthreaded bore, a screwthreaded element such as a bolt engaging said bore and a member receiving the object and extending away from said web.

BACKGROUND OF THE INVENTION

A bracket of this kind is, for example, a clamp for fastening a connecting lead to a ground rod or electrode. In such a known clamp the web and the receiving member are made of copper alloy, by casting, die casting, thermopressing or from an extruded profile. The receiving member surrounds an opening in which the ground electrode and the connecting lead are arranged in common and firmly clamped together by the screwthreaded element in the form of a bolt extending in the opening of the receiving member. By using die-casting or one of the other above-mentioned methods, the clamp is expensive.

SUMMARY OF THE INVENTION

The object of the invention is to provide such a clamp and, in general, a bracket of the kind set forth above which is effective yet can be manufactured at substantially lower costs.

With a bracket according to the invention this is achieved by using a receiving member of bent sheet material and by forming the web from at least one semicylindrical end of the receiving member provided with an internal screwthread and an annular element, for example, a ring or sleeve surrounding said end and engaging the screwthreaded element. For the manufacture of a bracket embodying the invention it is, therefore, sufficient to use a readily available commercial material which is of a, relatively inexpensive bending gauge so that his bracket may be made less expensively than a bracket manufactured by conventional methods.

In a very advantageous embodiment of the invention the screwthreaded element has a length such that it can come into contact with the object across the opening in the web, while the receiving member is outwardly bent with respect to a tangential line to the adjacent end. When the bracket is tightened by forcibly screwing the screwthreaded element against the object, the outwardly bent parts of the receiving member adjacent the ends are exposed to an inwardly directed reactive force. Thus the ends having internal screwthreads are more strongly pressed against the screwthreaded element so that a satisfactory transfer of forces and, in addition, a clamping effect are obtained.

In a further advantageous embodiment a small rim of the end protruding beyond the annular element is bent over outwardly. The annular element can thus be slipped onto the ends when the latter are pinched towards one another with the screwthreaded element not being present. When the screwthreaded element is put in place, this inward movement is no longer possible so that the annular element is locked up.

The screwthreaded element used for such a clamp is preferably a bolt formed of a corrosion resistant alloy and having appropriate strength together with satisfactory resistance to corrosion.

Other objects and advantages of the present invention will become apparent as the following description proceeds.

To the accomplishment of the foregoing and related ends the invention then comprises the features hereinafter fully described and particularly pointed out in the claims, the following description and the annexed drawings setting forth in detail certain illustrative embodiments of the invention these being indicative, however, of but a few of the various ways in which the principles of the invention may be employed.

DESCRIPTION OF THE PREFERRED EMBODIMENT

Figure 1:
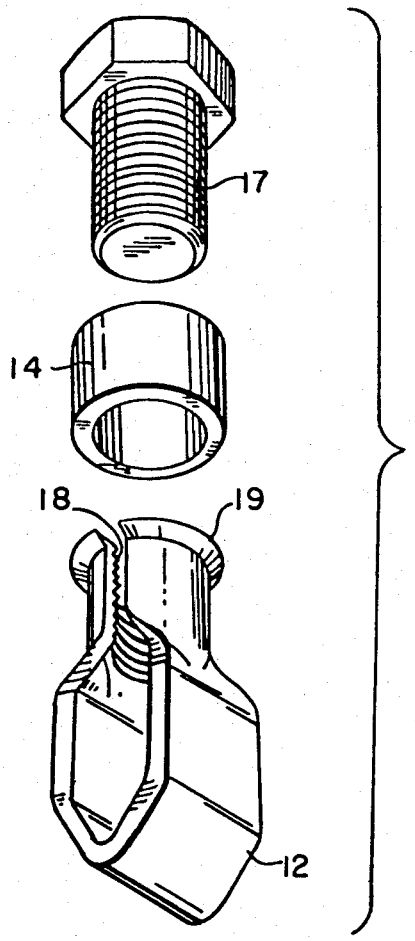
FIG. 1 is a perspective view of dissembled parts of a connection embodying the invention in the form of a ground rod clamp.

The receiving member 12 of the connection 10 is bent round in an uninterrupted shape and the web 11 comprises the two ends 13 of the receiving member 12. The web 11 comprises futhermore a ring 14 extending around the ends 13. The connection 10 is particularly intended to clamp a connecting wire 16 to a ground electrode 15.

The two ends 13 of the receiving member 12 are bent into a semicylindrical shape and the inner surface of said ends had a screwthread 18. A threaded bolt 17 can engage the screwthread 18. Also with this bracket embodying the invention the ends 13 are held together by the ring 14 so that the bolt 17 may strongly clamp the ground electrode 15 located in the receiving member 12 against the connecting wire 16 without deflection of the ends 13 of the receiving member. Without the bolt 17 being arranged in place the ring 4 can be arranged across the rim 19 and around the ends 13 of the receiving member 12 by pinching said ends towards one another. When afterwards the bolt 17 is mounted, the ring 14 is thus locked in place by the rim 19.

According to a further aspect of the invention the parts 20 of the receiving member 12 are outwardly bent with respect to a tangential line 21 starting from the adjacent end 13 to the ground electrode 15. When the bolt 17 is vigorously screwed into the screwthreaded opening of the web 11 in order to clamp together the ground electrode 15 and the connecting wire, the parts 20 are exposed to a reactive force tending to stretch said parts 20. With reference to FIG. 4 it will be apparent that in this way the lower parts of the ends 13, that is to say the parts neighboring the parts 20 are forced towards one another. This results in the engagement between the screwthread 18 and the bolt 17 being strengthened and, moreover, the bolt 17 is more securely gripped by the clamping effect.

The receiving member 12 is furthermore advantageously provided at its end opposite the web 11 with an acute corner 22 so that the connecting wire 16 firmly is gripped between the electrode 15 and the inside radius of the acute corner.

Figure 2:
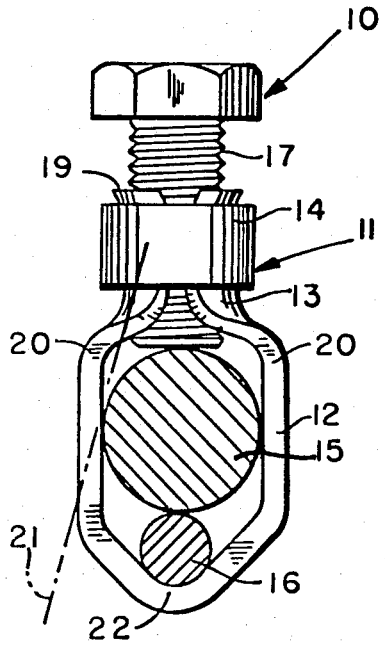
FIG. 2 is a horizontal section of the connection.

The receiving member 12 may be made from any suitable sheet material and for the use shown in FIGS. 1 and 2 it is made from copper sheet. The bolt 17 is preferably made of a corrosion resistant alloy.

I claim:

1. An electrical bracket for clamping a lead wire and ground rod in electrical contact and parallel to each other, said bracket being formed of a bent resilient sheet metal web and forming a wire and rod receiving portion in the general form of a closed hexagonal shape, said web including at one end of said closed hexagonal receiving portion two semi-cylindrical end portions having screw threads on the interior thereof cooperating to form an internally threaded bore extending generally normal to the axis of the ground rod, each semi-cylindrical end portion including a flared outer end which flared ends together form a rim, a screw threaded element adapted to be received in said internally threaded bore whereby tightening of the screw threaded element will clamp the rod and wire together between the end of the screw threaded element and the opposite end of the hexagonal wire and rod receiving portion, and a ring extending around said two semi-cylindrical end portions to restrict the opening of said end portions when said screw threaded element is threaded into said internally threaded bore and to maintain the screw threads on the interior of said semi-cylindrical end portions in proper threaded engagement with the threads of the screw threaded element, said sheet metal web being sufficiently resilient so that the semi-cylindrical end portions may be forced together when the screw threaded element is not present to permit said ring to be inserted over said rim.

2. A bracket as set forth in claim 1 wherein said sheet metal web is made of a strip of copper.

3. A bracket as set forth in claim 1 wherein such screw threaded element is a corrosion resistant bolt.

4. A bracket as set forth in claim 1 wherein said flared ends extend outwardly at an angle to the axis of the threaded bore of less than 90°.

5. A bracket as set forth in claim 1 wherein said closed hexagonal shape extends from the two cylindrical end portions at an angle substantially tangent to the circumference of the ground rod adapted to be embraced by the closed hexagonal shape.

6. A bracket as set forth in claim 5 wherein the end of said closed hexagonal shape opposite the threaded bore has a rounded angle adapted to embrace the lead wire and pull it against said ground rod when said screw threaded element is tightened in said threaded bore.

* * * * *